United States Patent [19]

Dagenhart et al.

[11] 4,329,586

[45] May 11, 1982

[54] ELECTRON ENERGY RECOVERY SYSTEM FOR NEGATIVE ION SOURCES

[75] Inventors: William K. Dagenhart; William L. Stirling, both of Oak Ridge, Tenn.

[73] Assignee: The United States of America as represented by the United States Department of Energy, Washington, D.C.

[21] Appl. No.: 187,915

[22] Filed: Sep. 17, 1980

Related U.S. Application Data

[63] Continuation-in-part of Ser. No. 88,223, Oct. 25, 1979, abandoned.

[51] Int. Cl.[3] ..... H01J 27/00

[52] U.S. Cl. ..... 250/426; 250/423 R

[58] Field of Search ..... 250/426, 423 R; 313/359, 361, 363

[56] References Cited

U.S. PATENT DOCUMENTS

| | | | |
|---|---|---|---|
| 2,725,480 | 11/1955 | Richardson | 250/426 |
| 2,889,462 | 6/1959 | Oppenheimer | 250/426 |
| 2,891,163 | 6/1959 | Clark | 250/426 |
| 2,933,630 | 4/1960 | Luce | 250/426 |

OTHER PUBLICATIONS

"High Current Negative Ion Beams", Prelee et al., *IEEE Transactions on Nucl. Sci.,* vol. NS-24, No. 3, Jun. 1977.

*Primary Examiner*—Bruce C. Anderson

*Attorney, Agent, or Firm*—David E. Breeden; Stephen D. Hamel; Richard G. Besha

[57] ABSTRACT

An electron energy recovery system for negative ion sources is provided. The system, employs crossed electric and magnetic fields to separate the electrons from ions as they are extracted from a negative ion source plasma generator and before the ions are accelerated to their full kinetic energy. With the electric and magnetic fields oriented 90° to each other, the electrons are separated from the plasma and remain at approximately the electrical potential of the generator in which they were generated. The electrons migrate from the ion beam path in a precessing motion out of the ion accelerating field region into an electron recovery region provided by a specially designed electron collector electrode. The electron collector electrode is uniformly spaced from a surface of the ion generator which is transverse to the direction of migration of the electrons and the two surfaces are contoured in a matching relationship which departs from a planar configuration to provide an electric field component in the recovery region which is parallel to the magnetic field thereby forcing the electrons to be directed into and collected by the electron collector electrode. The collector electrode is maintained at a potential slightly positive with respect to the ion generator so that the electrons are collected at a small fraction of the full accelerating supply voltage energy.

7 Claims, 4 Drawing Figures

ELECTRON ENERGY RECOVERY SYSTEM FOR NEGATIVE ION SOURCES

This invention is a result of a contract with the U.S. Department of Energy.

BACKGROUND OF THE INVENTION

This application is a continuation-in-part to application Ser. No. 88,223, filed Oct. 25, 1979, abandoned.

The present invention relates generally to negative ion sources and more particularly to improvements in the energy efficiency of negative ion sources.

In the development of ion sources to be used in the production of intense neutral beams for injection into magnetic fusion devices, various types of ion generators have been investigated and various improvements have been made in order to obtain an ion beam having sufficient duration and energy required for the production of intense neutral beams sufficient for use as heating plasma in magnetic fusion devices. One of the more serious problems encountered in the development of negative ion sources for these applications is the simultaneous generation and acceleration of electrons along with the negative atomic ions. Results of tests of several types of sources operated in various modes, indicate that about equal amounts of electrons and ions are accelerated even under the best conditions. These accelerated electrons constitute a power loss to the system, but a more serious problem is the very high power densities which they deposit on vital parts of the beam line surrounding the source assembly when accelerated to full kinetic energy by the accelerating supply voltage. These power densities, in the case of long pulse lengths, are sufficient to raise the temperature of water-cooled metal surfaces above their melting temperatures. For large negative ion sources applied to fusion neutral beam lines, these electron powers can exceed several hundreds of kilowatts for many seconds and at power densities exceeding 5 kw/cm$^2$. Thus, high power negative ion sources, previously employed, have all been restricted to pulse lengths of less than a few tens of milliseconds due in part to the high power electron losses. In these short pulse applications it is possible to allow the electrons extracted from the ion generator to be deflected from the main beam and accelerated into electron dumps. Their energy is dissipated by various parts of the beam line assembly. However, for longer pulse lengths and high density beams the generator energy drain of full energy dumping of unwanted electrons and the inherent damage to the ion source structure does not permit present ion beam generators to operate in a mode which is necessary for fusion devices. Thus, there is a need for improvements in ion generators to recover the electron energy to permit highpowered negative ion sources to operate with pulses of several seconds to meet the requirements for plasma heating of fusion devices.

SUMMARY OF THE INVENTION

In view of the above need it is an object of the present invention to provide an improved extraction system for a negative ion source wherein the extracted electrons are substantially separated from the ion beam and collected before the extracted ions are accelerated to their full energy component.

Another object of this invention is to provide an improved extraction system for a negative ion source which permits the source to operate for extended pulse durations without substantial energy losses due to the dumping of full-energy electrons extracted from the ion generator.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations as particularly pointed out in the appended claims.

To achieve the foregoing and other objects and in accordance with the purpose of the present invention as embodied and broadly described herein, the electron energy recovery system of this invention employs crossed electric and magnetic fields which separate the electrons from ions as they are extracted from an ion generator and before the ions are accelerated to their full energy according to the applied acceleration potential. The electric and magnetic fields are oriented 90° to each other in the ion source exit region so that the electrons migrate in a precessing motion in a direction perpendicular to both the magnetic and electric fields while remaining approximately at the electrical potential at which they were generated. The ions extracted from the source are accelerated to the full energy of the accelerating voltage supply while being deflected through an angle of less than 90°. The electrons precess out of the accelerating field region into an electron recovery region provided by an electron recovery means including an electron collector electrode maintained at a potential which is only slightly positive with respect to the potential applied to the generator. The collector electrode is disposed in a uniform spaced relationship with a surface of the generator which is transverse to the direction of migration of the electrons. An electron recovery region is formed between the electron collector electrode and the generator surface. The electron collector electrode and the corresponding surface of the generator include a region of non-planar surface common contour which provides an electric field component in a direction parallel to the applied magnetic field to redirect and accelerate the electrons entering the recovery region into the electron collector electrode. This forces the electrons to be collected at a small fraction of the full accelerating supply energy.

BRIEF DESCRIPTION OF THE DRAWINGS

The accompanying drawings, which are incorporated in and form a part of the specification, illustrate the present invention, and together with the description, serve to explain the principles of the invention. In the drawings.

Figure 1:
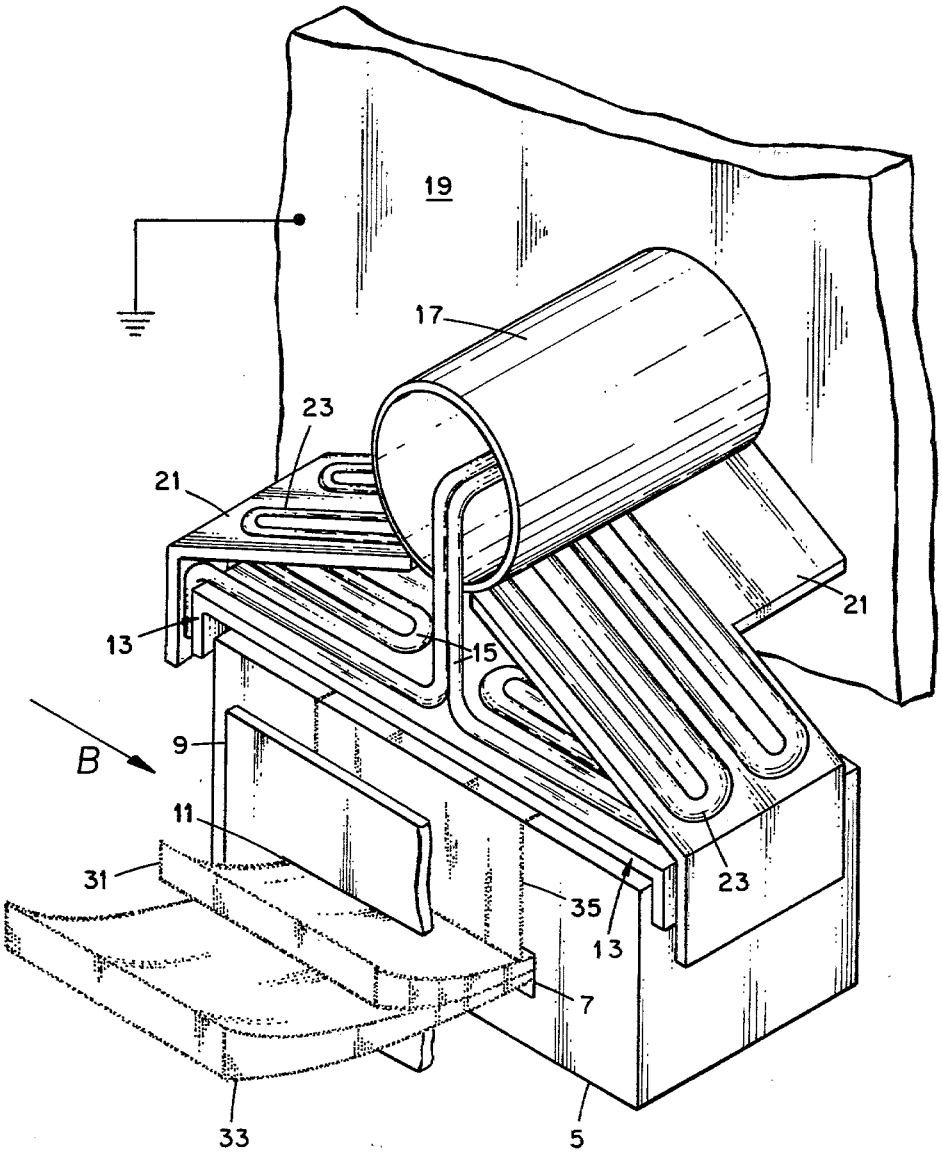
FIG. 1 is an isometric view of a negative ion generator including an electron energy recovery system made in accordance with the present invention.

orientation relative to the applied magnetic field (B) to obtain electron collection on the electron collector electrode in the electron recovery region formed by the uniform spacing between the collector electrode and the ion generator housing surface.

DESCRIPTION OF THE PREFERRED EMBODIMENT

Referring now to the drawings, there is shown a negative ion source from which a beam of negative ions is extracted and directed along a prescribed path in a conventional manner, not shown, for various ion beam applications. A rectangular box-shaped ion generator 5 defines an arc chamber in which is established an arc plasma containing the desired atomic species of negative ions. The ion generator may take various forms such as an Oak Ridge National Laboratory calutron Penning discharge negative ion generator. In such an ion generator $H^+$ ions are generated in the arc chamber by a hot cathode electron discharge from neutral gaseous $H_2$. Negative ions are generated on a negatively biased molybdenum convertor plate partially covered with cesium and bombarded with $H^+$, $H^0$ and $H_2$ particles. The plasma consists of $H^+$ and $H^-$ ions, electrons, $H^0$ atoms and $H_2$ molecules in approximately electrical neutrality.

Figure 2:
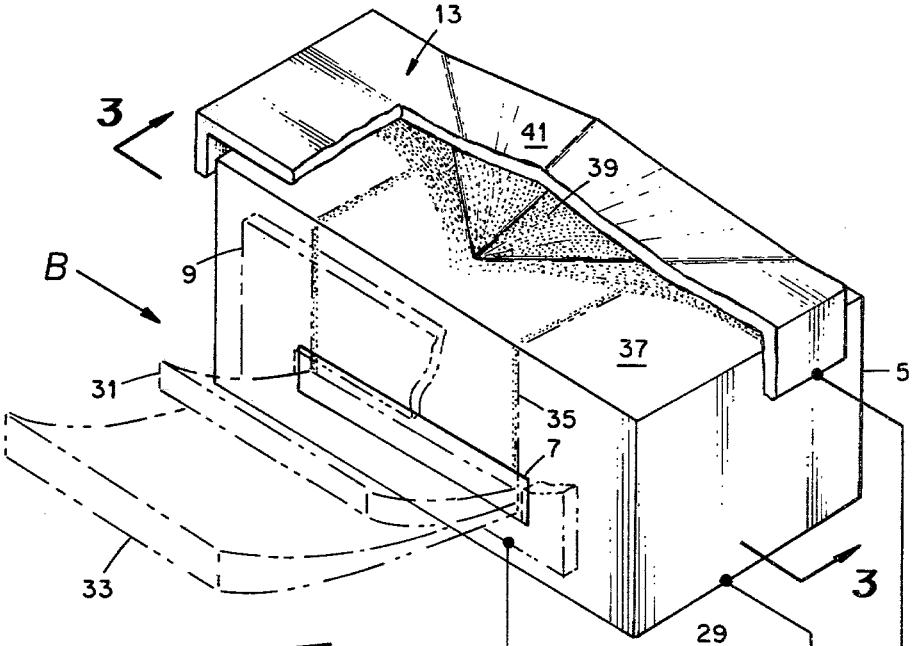
FIG. 2 is an isometric view of the ion generator of FIG. 1 with the top ground shield and cooling structure removed to illustrate the electron collector electrode and corresponding generator surface common contour for producing electric fields which aid in collecting electrons on the collector at a small fraction of their full kinetic energy.

The ion generator 5 is provided with an ion exit slit 7 from which the plasma generated within the arc chamber of the generators is extracted. An acceleration electrode 9, in the form of an electrically conductive plate extending over a portion of the front surface of the generator 5, is provided with an ion exit slit 11 corresponding to the position of the exit slit 7 of the ion generator 5. The electrode 9 is disposed in a spaced relationship from the ion generator 5 and is connected to ground potential, as shown in FIG. 2. An electron collector electrode 13 is mounted above the ion source generator 5 in a uniform-spaced relation thereto. A plurality of tubular members 15 through which cooling water flows is mounted on the top of the electrode 13 and extends upward therefrom and into a tubular ground shield member 17. The ground shield 17 is connected to a vacuum plate assembly 19 (partially shown) which forms an access port into a vacuum chamber within which the ion source is mounted by means of the face plate 19. The tubular members 15 act as structural members supported within the guard ring 17 by means of insulators (not shown) to support the electron collector electrode 13 in its position over the ion generator 5. The ion generator 5 is mounted to the plate 19 by means of insulators (not shown). A second ground shield member 21 which is supported directly by the plate 19 extends over the entire collector electrode structure 13. A series of cooling liquid channels 23 are provided which connect through the plate 19 to the cooling water supply to aid in cooling the assembly.

The electron collector electrode 13 is adapted to be connected to the positive side of an electron collector voltage supply 27 of approximately 2 kv. The negative side of the supply is connected to the generator 5 as shown in FIG. 2. The acceleration voltage (−25 kv) is provided by connecting the position side of the accelerating voltage supply 29 to the generator 5 housing and connecting the plus side to ground potential, the potential at which the acceleration electrode 9 is held. In this arrangement the electron collector electrode is held slightly more positive (2 kv) than that of the ion generator 5 which is at −25 kv. This has been found sufficient to collect the electrons without a full acceleration supply voltage (−25 kv) energy loss. By connecting the collector 13 supply voltage (+2 kv) between the generator and collector, as shown, the generator current drain due to electron current is reduced substantially as compared to sources wherein the electrons are dumped at full acceleration potential drop.

A small fraction of the electrons generated by collision of negative ions with neutral gas in the accelerator gap are born at potentials closer to ground than the electron collector electrode. These electrons are not collected by the collector electrode 13 but are collected with full energy of the accel supply on electrode 21. Electrode 17 is at ground potential and shields the insulators which provide the −23 kv potential to electrode 13 from direct ion bombardment by any contaminant ions which might be present during initial source startup.

The entire ion source is immersed in a magnetic field (B) within a vacuum chamber of which only a wall portion 19 is shown. The magnetic field is provided in a conventional manner by suitable electromagnets, not shown, so that the entire source arrangement and the exiting ions are in a uniform magnetic field transverse (in the direction shown in FIG. 1) to the exit direction of the ions from the exit slit 7. The acceleration electrode 9 provides an electric field which is oriented at 90° with respect to the magnetic field B.

As pointed out above, as the ions are extracted from the generator 5 through the slit 7 by the electric field provided by the electrode 9, the ions are accelerated to full acceleration supply energy (25 keV) and travel away from the source to be guided along an ion beam path 31 as required.

The ion beam may be composed of deuterium ions generated as described above for the hydrogen ions by introducing neutral deuterium into the gas chamber of the generator 5. In either case the heavy $H^-$ or deuterium negative ions exit along a beam path 31 separated from any contaminant ion beam 33 made up of heavier negative ions which may be present during source operation (e.g., $O^-$, $C^-$, etc.) and on a different curvature path due to their differences in charge-to-mass ratio.

Due to the light mass of the electrons, they are quickly separated at the exit 7 and migrate along the face of the generator 5 along a path 35 which is perpendicular to both the direction of the magnetic field B and the acceleration electric field provided between the acceleration electrode 9 and the generator 5. Due to the crossed electric and magnetic field directions, as illustrated, electrons travel upward in a precessing motion confined within the space between the generator 5 and the electrode 9. These electrons remain at approximately full acceleration potential until they are collected on the electrode 13. An electron recovery region is provided between the electron collector electrode 13 and the ion generator housing 5. The electrons 35 move into the recovery region initially due to the direction of a small electric field provided by the electron collector voltage being maintained slightly positive with respect to the generator 5 housing. As the electrons migrate into the recovery region, a small electric field component ($E_x$) substantially parallel to the magnetic field B is created by a non-planar surface contour portion of the uniformly spaced-apart electrode 13 and corresponding surface 37 of the ion generator housing 5.

Figure 4:
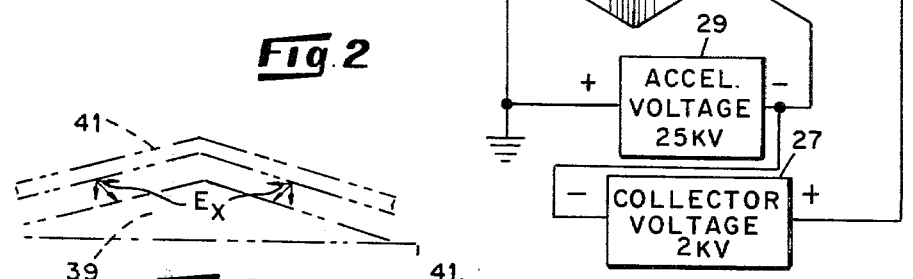
FIG. 4 is a partial, sectional view of the electron recovery region which illustrates the electric field (E)
Figure 3:
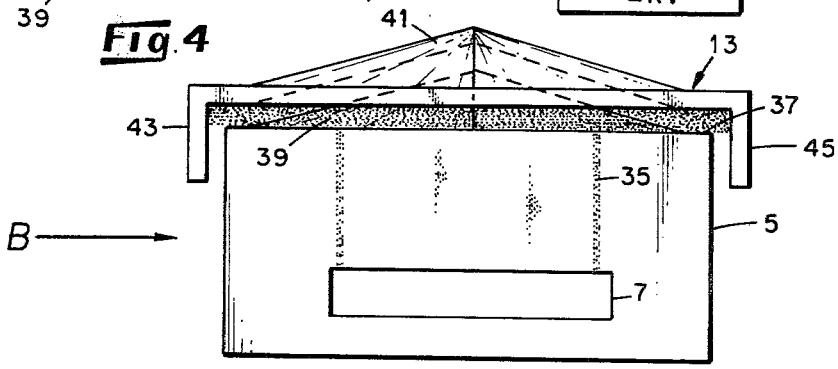
FIG. 3 is a view taken along line 3—3 shown in FIG. 2.

In the embodiment shown, the non-planar contour is provided by a raised portion 39 of the generator surface 37 with a corresponding contoured portion 41 of the electrode 13 to maintain uniform spacing between electrode 13 and the surface 37, as more clearly shown in FIG. 3. The outward protruding surfaces (37 and 41 of the generator 5 top and electrode 13, respectively) are uniformly inclined along shewed paths to the direction of electrons (35) entering the recovery region. This non-planar contour provides a small electric field component $E_x$ (FIG. 4) parallel to the magnetic field B which aids in dispersing and directing the electrons 35 into the collector electrode 13 which is only slightly more positive with respect to the generator 5 housing. Therefore the electrons are collected without experiencing the full accelerating potential drop as in the normal ion source configuration where the electrons are allowed to experience full acceleration potential to collision with a surface, such as the grounded vacuum housing or grounded parts of the source. With the configuration as shown and described, electrons have been collected at an energy loss as low as 0.5 keV as compared to the full 25 keV energy loss when allowed to impinge upon the various ion source components as was previously the case. This technique is especially significant in the present invention since essentially all of the electrons are generated in the ion source arc discharge and not from the electrode high pressure region.

The electron collector electrode is further provided with end portions 43 and 45 which extend down the sides of corresponding sides of the generator housing 5. In this region the electric field provided between the electrode 13 and the housing 5 is substantially parallel to the magnetic field B. This ensures that the electrons which are redirected to drift parallel to the magnetic field (B) are further accelerated in these regions along paths parallel to field B and forced into the collector electrode 13.

In preliminary tests performed on the present device using a 2 $cm^2$ extraction slit with 12 cm length, an accel potential of −25 kv and electron collector electrode potential of −23 kv, an extraction electron current of about 1 amp operating in a DC mode was dissipated and showed no significant heating of surfaces due to electron currents. Previous testing without the present electron collection technique resulted in melting of source components and the release of cooling water to the vacuum tank.

Collection efficiencies of extracted electrons have ranged from 97.5% at less than 10% of full energy under poor operating conditions to greater than 99% at less than 4% of full energy under optimum operating conditions. Using the best values of $I_e/I_H- = 4$ for the ratio of extracted electron current to the negative ion current with a calutron Penning negative ion source, the following percentages, $\eta$, of beam power supply energy delivered to the negative ion beam were achieved: without electron energy recovery, $\eta = 20\%$; with electron energy recovery, $\eta = 83\%$.

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments as are suited to the particular use contemplated. It is intended that the scope of the invention be defined by the claims appended hereto.

What is claimed is:

1. In a negative ion source for producing a beam of accelerated negative ions including means for generating a magnetic field, a vacuum chamber disposed with said field, a negative ion generator disposed within said chamber and maintained at a negative operating potential relative to said chamber, said ion generator including at least one ion exit opening therein, and an acceleration electrode disposed opposite said ion exit opening of said generator and maintained at a positive potential relative to said ion generator for extracting ions from said generator and generating an electric field transverse to said magnetic field so that electrons exiting said generator with said ions are forced to migrate in a direction transverse to both said electric and magnetic fields, the improvement comprising;

an electron recovery means including an electron collector electrode disposed in uniform spaced relation with a conductive surface of the same operating voltage as said ion generator and transverse to the direction of migration of said electrons forming an electron recovery region therebetween into which said migrating path of electrons are directed, a collector voltage source means for maintaining said electron collector electrode at a potential positive with respect to said ion generator and substantially less positive than said acceleration electrode, said conductive surface and said electron collector electrode each including a non-planar surface contour portion to provide an electric field component in said electron recovery region parallel to said magnetic field to accelerate said electrons in said recovery region into said electron collector electrode within said recovery region.

2. The combination as set forth in claim 1 wherein said non-planar surface contours of said electron collector electrode and said surface include corresponding surface portions protruding in opposing direction to that of the direction of the electric field in the planar surface portions thereof.

3. The combination as set forth in claim 2 wherein said protruding surface portions of said collector electrode and said surface are uniformly inclined along skewed paths to the direction of the path of electrons entering said recovery region so that said electrons are gradually redirected by said electric field component parallel to said magnetic field in directions parallel to said magnetic field to impinge upon said electron collector.

4. The combination as set forth in claim 3 wherein said conductive surface is a surface of said ion generator.

5. The combination as set forth in claim 4 wherein said ion generator is defined by a generally rectangular box structure and wherein said electron collector electrode further includes perpendicularly extending opposite end portions in overlapping uniform spaced relationship with corresponding end surfaces of said ion generator for intercepting said redirected electrons moving in paths parallel to said magnetic field to force said redirected electrons reaching said end portions of said electron collector electrode to be further accelerated into and thereby collected by said electron collector.

6. The combination as set forth in claim 5 wherein said acceleration electrode and said vacuum chamber are operated at ground potential and further including an accelerating power supply having its negative side connected to said ion generator and its positive side connected to said acceleration electrode and wherein said collector voltage source means includes a collector power supply having a positive side connected to said electron collector electrode and a negative side connected to said ion generator.

7. The combination as set forth in claim 6 wherein said acceleration supply voltage is greater than 25 kv and wherein said collector supply voltage is approximately 2 kv.

* * * * *